US008745929B2

(12) United States Patent
Way

(10) Patent No.: US 8,745,929 B2
(45) Date of Patent: Jun. 10, 2014

(54) PIVOTING SHELTERS

(76) Inventor: Mansen W. Way, Corydon, IN (US)

( * ) Notice: Subject to any disclaimer, the term of this patent is extended or adjusted under 35 U.S.C. 154(b) by 0 days.

(21) Appl. No.: 13/450,139

(22) Filed: Apr. 18, 2012

(65) Prior Publication Data

US 2012/0317897 A1 Dec. 20, 2012

Related U.S. Application Data

(60) Provisional application No. 61/476,711, filed on Apr. 18, 2011.

(51) Int. Cl.
*E04B 7/16* (2006.01)
*E04B 1/34* (2006.01)
*E04F 10/00* (2006.01)

(52) U.S. Cl.
CPC ..... *E04F 10/005* (2013.01)
USPC ..... 52/74; 52/65

(58) Field of Classification Search
USPC ..... 52/73, 74, 65, 66, 29; 135/98
See application file for complete search history.

(56) References Cited

U.S. PATENT DOCUMENTS

| | | | | |
|---|---|---|---|---|
| 5,390,719 | A * | 2/1995 | Barnes | 160/10 |
| 6,591,556 | B2 * | 7/2003 | Bertheaume et al. | 52/74 |
| 2004/0069333 | A1 * | 4/2004 | Ma | 135/20.1 |
| 2006/0243311 | A1 * | 11/2006 | Glatz | 135/120.2 |
| 2007/0074461 | A1 * | 4/2007 | Porter et al. | 52/73 |
| 2008/0053496 | A1 * | 3/2008 | Li | 135/16 |
| 2008/0196754 | A1 * | 8/2008 | Saiz | 135/98 |
| 2008/0216418 | A1 * | 9/2008 | Durham | 52/73 |

* cited by examiner

*Primary Examiner* — William Gilbert
*Assistant Examiner* — Kyle Walraed-Sullivan
(74) *Attorney, Agent, or Firm* — Hodgson Russ LLP

(57) ABSTRACT

A pivoting shelter comprises a support member, such as a support post, and a pivot affixed to the support member. The pivoting shelter has a shelter member attached to the pivot such that the shelter member is capable of rotating relative to the support member about a rotational axis. The pivot is attached to the shelter member so that the rotational axis is substantially perpendicular to a primary plane of the shelter member and at a position along the side of the shelter member other than the center of a side. For example, the rotational axis may be located substantially at a corner of the shelter member.

7 Claims, 3 Drawing Sheets

PIVOTING SHELTERS

CROSS-REFERENCE TO RELATED APPLICATION

This application claims the benefit of priority to U.S. provisional patent application Ser. No. 61/476,711, filed on Apr. 18, 2011, now pending, the disclosure of which is hereby incorporated by reference.

FIELD OF THE INVENTION

The invention relates to the field of shelters, and more particularly to shelters for drive-up kiosks.

BRIEF SUMMARY OF THE INVENTION

Drive-up kiosks have become ubiquitous in modern society. Restaurants with drive-through service have order boards, banks have automated teller machines, and drug stores have drive-up pharmacy windows. For the convenience and comfort of customers, many businesses with kiosks now provide shelters in order to protect customers from weather (e.g., rain, snow, etc.) while the customers use the kiosks Such shelters may be attached to a building or other structure—such as an awning. Other such shelters may be free-standing, aving a support post or similar support.

However, shelters are vulnerable to being struck by vehicles that are taller than the height at which the shelter is mounted. Vehicle impacts may cause damage to the shelter, the vehicle, and/or the structure to which the shelter is mounted, and may cause injury to people in the vicinity of the incident. To avoid vehicle strikes, numerous schemes have been devised. The simplest is a warning sign that states the height of the shelter so that an informed driver can avoid striking the shelter. In another system, a pre-shelter warning device is set at the same height as the shelter. In this way, a driver who strikes this warning device (which does not cause damage) will know not to continue driving toward the shelter.

Other devices exist which seek to minimize damage when a vehicle strike occurs. One such device, depicted in FIG. 1, shows a shelter attached to a single support post 101 at a position which is centered on a side of the shelter 109. The post 101 or attachment mechanism is able to pivot and allow the shelter 109 to rotate if the shelter 109 is struck by a vehicle 103 moving in path 105 to final position 107. In this way, the shelter 109 can swing out of harm's way rather than being struck in a fixed position. The pivoting mechanism may be provided with a return mechanism, such as a spring, that will cause the shelter to return to a "centered" position.

However, such prior art devices remain susceptible to damage because of the positioning of the support post with respect to the shelter. As can be seen in FIG. 1, the side of the shelter 109 closest to the vehicle 103 does not immediately rotate back into a safe position, but, because of the positioning of the rotation axis, this side must first move to a position which is further into the vehicle path 105 before being able to move back to a safe position. This initial "outwardly" movement allows some damage to occur to the shelter 109 (or support post, vehicle, etc.) Accordingly, there is a need for a shelter member which more completely avoids damage during a vehicle strike event.

BRIEF SUMMARY OF THE INVENTION

A pivoting shelter comprises a support member, such as a support post. A pivot is affixed to the support member. The pivot is capable of rotation relative to the support member. The pivoting shelter has a shelter member. The shelter member is attached to the pivot such that the shelter member is capable of rotating relative to the support member about a rotational axis. The pivot is attached to the shelter member so that the rotational axis is substantially perpendicular to a primary plane of the shelter member and is located substantially in a corner of the shelter member. In another embodiment according to the present invention, the pivot is attached to the shelter member such that the rotational axis is located on (or in front of, as further described below) a line that is perpendicular to the direction of travel of a vehicle in the drive up lane and the line is tangential with a forward most point of the shelter member.

DESCRIPTION OF THE DRAWINGS

For a fuller understanding of the nature and objects of the invention, reference should be made to the following detailed description taken in conjunction with the accompanying drawings, in which.

Other features of the invention can be found in the following description, the enclosed claims and/or the attached drawings.

DETAILED DESCRIPTION OF THE INVENTION

Figure 2A:
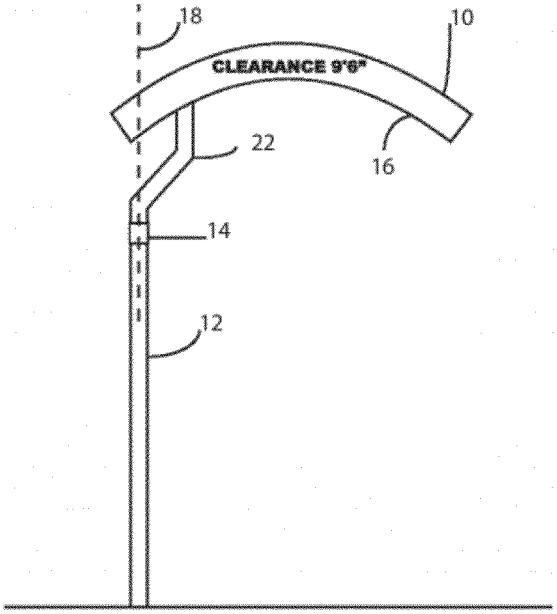
FIG. 2*a* is an elevation diagram of a pivoting shelter according to an embodiment of the present invention.

FIG. 2*a* is an elevation diagram of a pivoting shelter according to an embodiment of the present invention A pivoting shelter 10 of the present invention comprises a support member 12 in a fixed position. The support member 12 may be a support post which spans substantially all of the height of the shelter. A post of this type may be secured to the ground by way of a concrete foundation. The support member 12 may include attachment to some other structure such as, for example, the signage located near a kiosk. A pivot 14 is affixed to the support member 12. The pivot 14 may be near the top of the support member 12, near the bottom of the support member 12, or at some position between the top and the bottom. The pivot 14 is capable of rotation relative to the support member 12. In this way, an object attached to the pivot 14 will be able to rotate relative to the support member 12.

Figure 1:
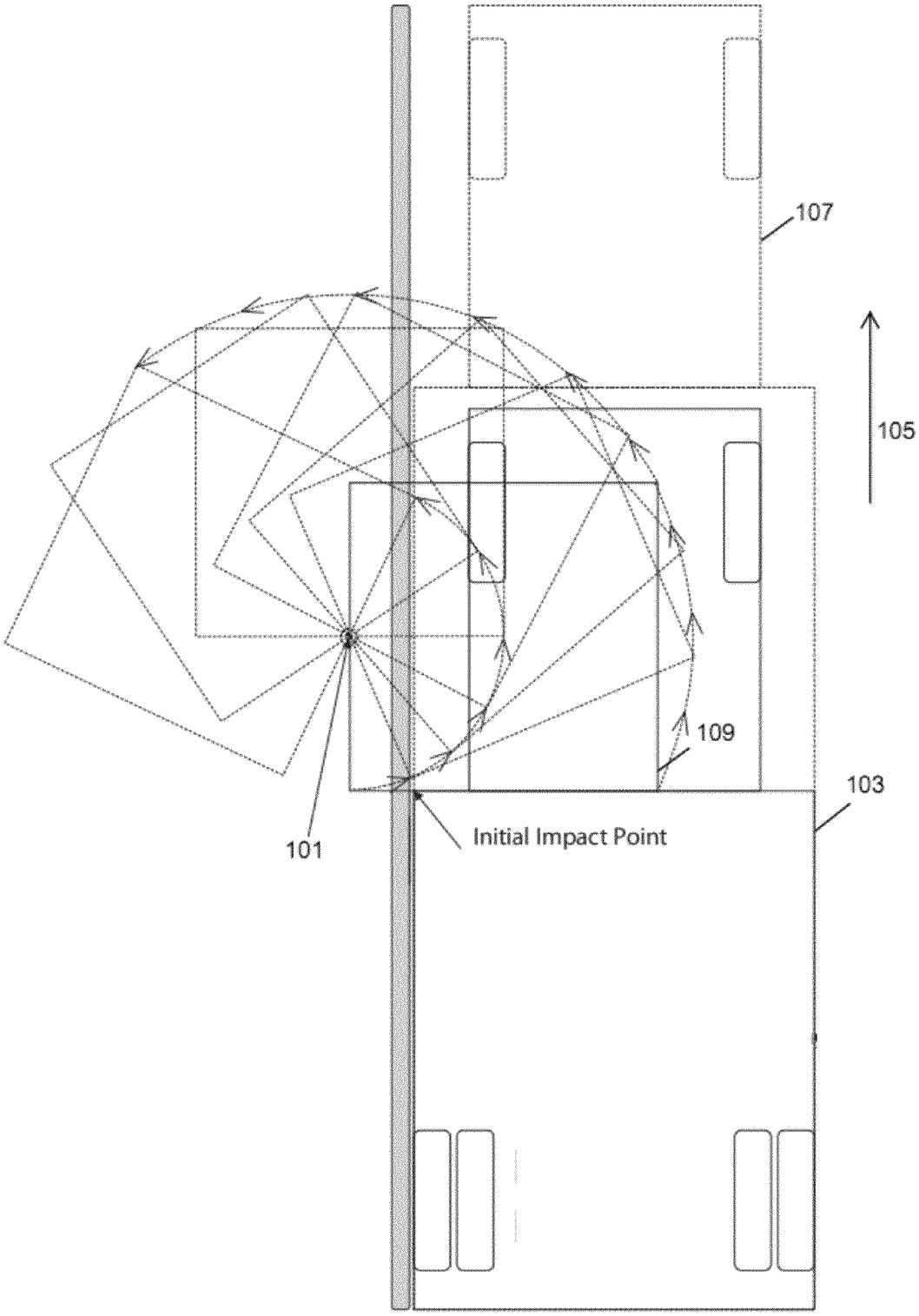
Fig. 1 (Prior Art)
FIG. 1 is a top view diagram of a prior art shelter and showing a vehicle contacting the shelter.
Figure 2B:
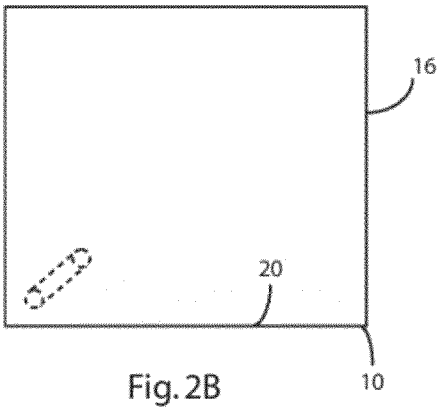
FIG. 2*b* is a top view diagram of the pivoting shelter of FIG. 2*a;*
Figure 3B:
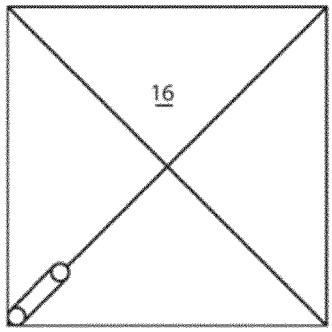
FIG. 3*b* is a top view diagram of the pivoting shelter of FIG. 3*a*.
Figure 3A:
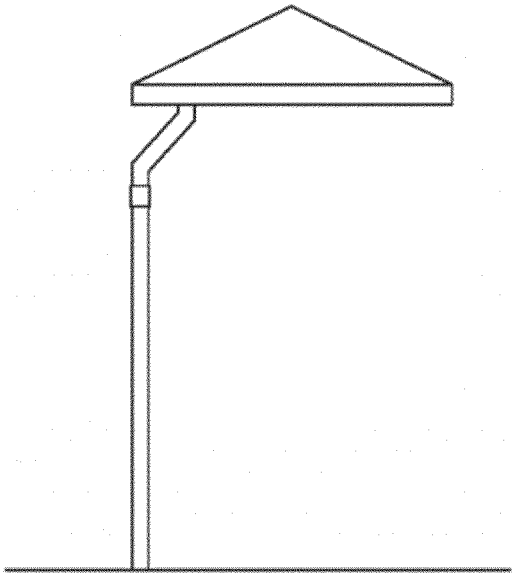
FIG. 3*a* is an elevation diagram of a pivoting shelter according to another embodiment of the present invention.

The pivoting shelter 10 has a shelter member 16. The shelter member 16 may be rectilinear or any other shape suitable for sheltering a customer during use of a drive-up kiosk. The shelter member 16 may be constructed from metal, plastic, fabric, or other water-shedding material (or a combination of any of these materials). The shelter member 16 may be constructed from a plurality of water-shedding components such as, for example, metal shingle components connected side-by-side to form a shelter 16 as show in FIGS. 3*a* and 3*b*.

The shelter member 16 is attached to the pivot 14 such that the shelter member 16 is capable of rotating relative to the support member 12 about a rotational axis 18. The pivot 14 is attached to the shelter member 16 so that the rotational axis 18 is substantially perpendicular to a primary plane of the shelter member 16 (generally, the horizontal plane). The pivot 14 is attached to the shelter member 16 so that the rotational axis 18 is located other than at the center of a side of the shelter member 16. In certain embodiments, the pivot 14 is attached to the shelter member 16 so that the rotational axis is located substantially at a corner of the shelter member 16. For example, in an embodiment, the rotational axis 18 is located at the corner of the shelter member 16 which is closest to the leading edge 20 of the shelter member 16. In this way, in the case of a vehicle strike, the shelter member 16 will quickly begin to rotate to a safe position.

Figure 4:
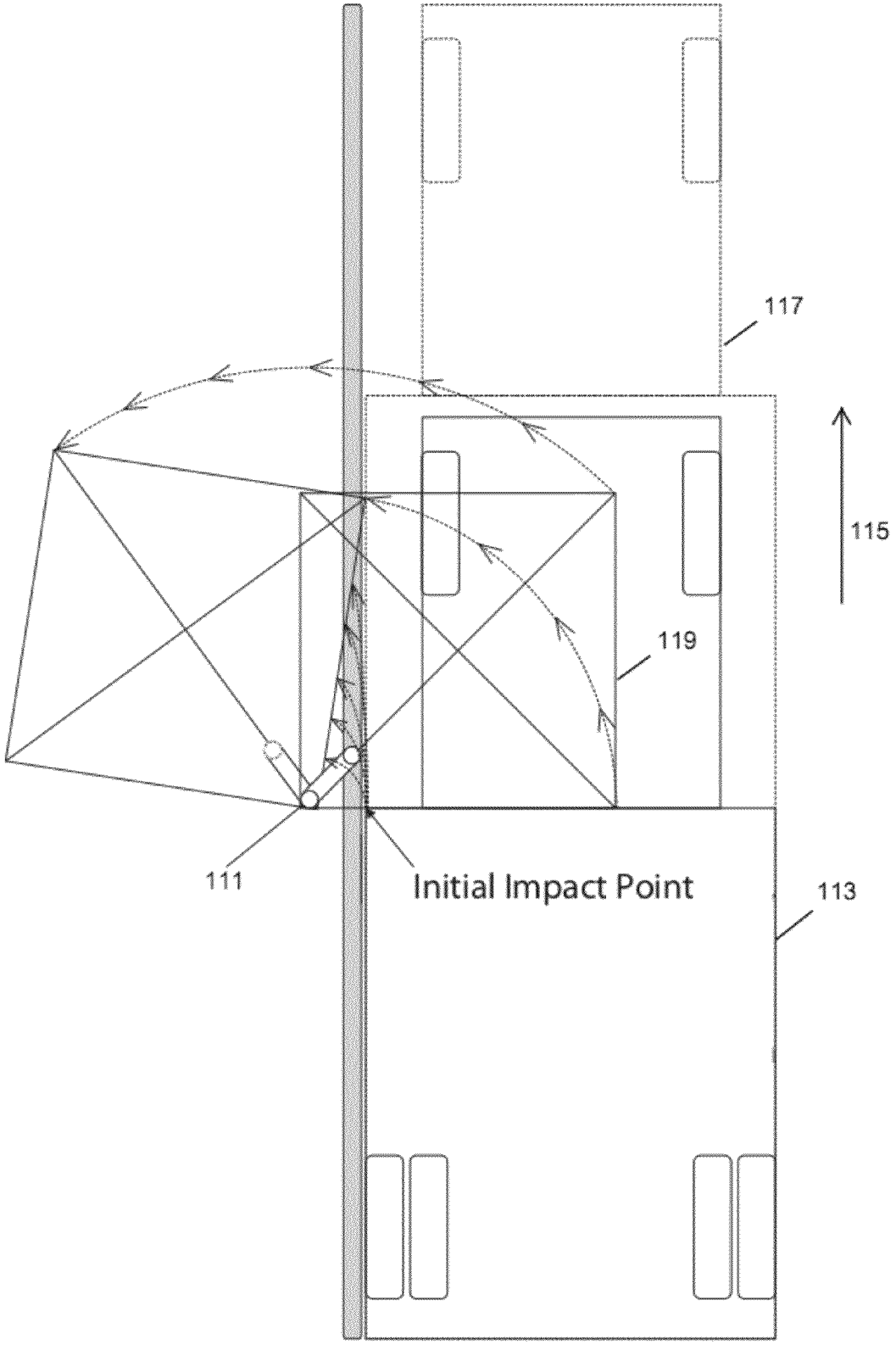
FIG. 4 is a top view diagram of a pivoting shelter according to an embodiment of the present invention and showing a vehicle contacting the pivoting shelter.

FIG. 4 is a top view diagram of a pivoting shelter according to an embodiment of the present invention and showing a vehicle 113 contacting the pivoting shelter 119. In this embodiment, the side of the shelter 119 closest to the vehicle 113 immediately rotates around axis 111 back into a safe position when the vehicle 113 travels in a path 115 ending at final position 117. As such, the shelter 119 completely avoids damage during a vehicle strike event.

The pivot 14 may be attached at a point other than the corner of the shelter member 16. For example, the pivot 14 may be attached at a point set in from the corner of the shelter member 16. However, the point of attachment of the pivot 14 to the shelter member 16 is selected such that the rotational axis is located other than at the center of a side of the shelter member 16, for example without limitation, substantially in a corner of the shelter member 16. The pivoting shelter 10 may further comprise an offset member 22 in order to locate the attachment point of the pivot 14 to an inset portion of the shelter member 16.

In a pivoting shelter of another embodiment, the shelter member may not be rectilinear, for example, the shelter member may be round or oval in shape (when view in the primary plane). In such an embodiment, the pivot is attached to the shelter member such that the rotational axis is located on (or in front of, as further described below) a line which is perpendicular to the direction of travel of a vehicle in the drive up lane and the line is tangential with a front edge of the shelter member. This configuration will also work with a rectilinear shelter member or a shelter member of any shape. So long as the rotational axis is aligned with or in front of the front edge as described above, the shelter will pivot to safety and minimize any damage caused by a vehicle strike.

It should be noted that terms such as front, back, forward, and backward are made with reference to the direction of vehicular traffic in the corresponding drive-through lane. For example, the front portion (and forward direction) of the shelter member is the portion which is first encountered by an approaching vehicle, whereas the back portion is the portion furthest from an approaching vehicle.

A pivoting shelter may further comprise a return mechanism which returns the shelter member to the initial "off-centered" position. The return mechanism may be a spring which is biased to urge the shelter to the initial position. The return mechanism may be a motor to move the shelter out of harms way upon an initial contact by a vehicle and back to the initial position after the vehicle has safely passed.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

I claim:

1. A pivoting shelter apparatus, comprising:

a support member;

a pivot affixed to the support member and capable of rotating relative to the support member;

a shelter member attached to the pivot such that the shelter member is capable of rotating relative to the support member; and wherein the pivot and shelter member are attached such that the shelter member rotates about an axis which is substantially perpendicular to a primary plane of the shelter member and located substantially at a point of the shelter member which is not a center of a side of the shelter member, and wherein the pivot is biased, using a spring, to a first position such that the shelter member is urged to return to the first position when rotated away from the first position.

2. The pivoting shelter of claim 1, wherein the support member is secured in a fixed position.

3. The pivoting shelter of claim 1, wherein the axis of rotation is located substantially at a corner of the shelter member.

4. The pivoting shelter of claim 1, wherein the shelter member is rectilinear.

5. The pivoting shelter of claim 4, wherein the shelter member is shaped as a rectangle along the primary plane.

6. The pivoting shelter of claim 1, further comprising an offset member disposed between the pivot and the shelter member, and the shelter member is attached to the pivot by way of the offset member.

7. A pivoting shelter apparatus, comprising:

a support member secured in a fixed position;

a pivot affixed to the support member and capable of rotating relative to the support member;

a shelter member attached to the pivot such that the shelter member is capable of rotating relative to the support member; and wherein the pivot and shelter member are attached such that the shelter member rotates about an axis which is substantially perpendicular to a primary plane of the shelter member, wherein the axis is aligned with or in front of a front edge of the shelter; and wherein the pivot is biased, using a spring, to a first position such that the shelter member is urged to return to the first position when rotated away from the first position.

* * * * *